US007234986B2

(12) United States Patent
Kowalski et al.

(10) Patent No.: US 7,234,986 B2
(45) Date of Patent: Jun. 26, 2007

(54) MAGNETIC CONSTRUCTION KIT WITH WHEEL-LIKE COMPONENTS

(75) Inventors: Charles J. Kowalski, Ridgewood, NJ (US); Jeffrey H. Rosen, Aventura, FL (US); Lawrence I. Rosen, Mendham, NJ (US)

(73) Assignee: Mega Brands America, Inc., Livingston, NJ (US)

( * ) Notice: Subject to any disclaimer, the term of this patent is extended or adjusted under 35 U.S.C. 154(b) by 125 days.

(21) Appl. No.: 10/965,980

(22) Filed: Oct. 15, 2004

(65) Prior Publication Data

US 2005/0159074 A1 Jul. 21, 2005

Related U.S. Application Data

(60) Provisional application No. 60/536,866, filed on Jan. 16, 2004.

(51) Int. Cl.
*A63H 33/10* (2006.01)
*A63H 33/00* (2006.01)

(52) U.S. Cl. ..... 446/92; 446/111; 446/129

(58) Field of Classification Search ..... 446/129, 446/133, 134, 111, 112, 115, 117, 122, 123; 273/156, 157 R
See application file for complete search history.

(56) References Cited

U.S. PATENT DOCUMENTS

| | | | | |
|---|---|---|---|---|
| 242,821 | A | | 6/1881 | Farmer |
| 1,236,234 | A | | 8/1917 | Troje |
| 1,472,536 | A | * | 10/1923 | Thomson ..... 434/403 |
| 1,535,035 | A | | 4/1925 | Philipp |
| 2,448,692 | A | | 9/1948 | Teetor |
| 2,570,625 | A | | 10/1951 | Zimmerman et al. |
| 2,795,893 | A | | 6/1957 | Vayo |
| 2,846,809 | A | | 8/1958 | Majewski |
| 2,872,754 | A | | 2/1959 | Cronberger |
| 2,939,243 | A | | 6/1960 | Duggar |
| 2,970,388 | A | | 2/1961 | Yonkers |
| 2,983,071 | A | | 5/1961 | Oliver |
| 3,077,696 | A | | 2/1963 | Barnett et al. |
| 3,095,668 | A | | 7/1963 | Dorsett |
| 3,184,882 | A | | 5/1965 | Vega |

(Continued)

FOREIGN PATENT DOCUMENTS

| | | |
|---|---|---|
| DE | 31 52 024 A1 | 12/1981 |
| DE | 33 23 489 | 1/1984 |
| DE | 39 10 304 A1 | 3/1989 |
| DE | 102 07 244 C1 | 2/2002 |
| DE | 202 02 183 U1 | 2/2002 |

(Continued)

OTHER PUBLICATIONS

International Search Report Apr. 14, 2003.

(Continued)

*Primary Examiner*—Kien Nguyen
(74) *Attorney, Agent, or Firm*—Michael Bednarek; Paul, Hastings, Janofsky & Walker LLP

(57) ABSTRACT

A movable magnetic construction kit that is suitable for creating a variety of different construction profiles and including at least one primary connecting element that can be operatively associated with one or more secondary connecting elements via magnetic and/or mechanical connections. The primary connecting element has at least one aperture therein and a plurality of magnets operatively associated with an edge thereof. The primary connecting element in combination with the secondary connecting elements provides for a movable construction kit for enhanced construction and design capabilities.

20 Claims, 2 Drawing Sheets

U.S. PATENT DOCUMENTS

| | | | | |
|---|---|---|---|---|
| 3,196,579 | A | 7/1965 | Lepper | |
| 3,254,440 | A | 6/1966 | Duggar | |
| 3,458,949 | A | 8/1969 | Young | |
| 3,594,924 | A | 7/1971 | Baker | |
| 3,601,921 | A | 8/1971 | Strohmaier | |
| 3,606,333 | A | 9/1971 | Green | |
| 3,655,201 | A | 4/1972 | Nichols | |
| 3,696,548 | A | 10/1972 | Teller | |
| 3,706,158 | A | 12/1972 | Jensen | |
| 3,844,664 | A * | 10/1974 | Hogan | 403/171 |
| 3,906,658 | A | 9/1975 | Gross | |
| 3,998,003 | A | 12/1976 | Rosenbaum | |
| 3,998,004 | A | 12/1976 | Ehrlich | |
| 4,020,566 | A | 5/1977 | Dreiding | |
| 4,026,086 | A | 5/1977 | Langley | |
| 4,118,888 | A | 10/1978 | Ogawa | |
| 4,238,905 | A | 12/1980 | MacGraw, II | |
| 4,258,479 | A | 3/1981 | Roane | |
| D264,694 | S | 6/1982 | Takahashi | |
| 4,334,870 | A | 6/1982 | Roane | |
| 4,334,871 | A | 6/1982 | Roane | |
| 4,364,196 | A | 12/1982 | Shacket | |
| 4,462,596 | A | 7/1984 | Yamamoto | |
| 4,509,929 | A | 4/1985 | Zawitz | |
| 4,513,970 | A | 4/1985 | Opresco et al. | |
| 4,629,192 | A | 12/1986 | Nichols | |
| 4,650,424 | A | 3/1987 | Mitchell | |
| 4,722,712 | A | 2/1988 | McKenna | |
| 4,741,534 | A | 5/1988 | Rogahn | |
| 4,836,787 | A | 6/1989 | Boo | |
| 4,865,324 | A | 9/1989 | Nesis | |
| 5,009,625 | A | 4/1991 | Longuet-Higgins | |
| 5,021,021 | A | 6/1991 | Ballard | |
| 5,061,219 | A * | 10/1991 | Glickman | 446/126 |
| 5,127,652 | A | 7/1992 | Unger | |
| 5,347,253 | A | 9/1994 | Ogikubo | |
| 5,409,236 | A | 4/1995 | Therrien | |
| 5,411,262 | A | 5/1995 | Smith | |
| 5,458,522 | A | 10/1995 | Brooks, III | |
| 5,487,691 | A | 1/1996 | Chiu | |
| 5,520,396 | A | 5/1996 | Therrien | |
| 5,545,070 | A | 8/1996 | Liu | |
| 5,643,038 | A | 7/1997 | Olsen et al. | |
| 5,651,715 | A | 7/1997 | Shedelbower | |
| 5,743,786 | A | 4/1998 | Lindsey | |
| 5,746,638 | A | 5/1998 | Shiraishi | |
| 5,785,529 | A | 7/1998 | Hearn et al. | |
| 5,826,872 | A | 10/1998 | Hall | |
| 5,833,465 | A | 11/1998 | Jarzewiak | |
| 5,848,926 | A | 12/1998 | Jardetzky et al. | |
| 5,873,206 | A | 2/1999 | Roberts | |
| 5,921,781 | A * | 7/1999 | Shaw | 434/298 |
| 6,017,220 | A | 1/2000 | Snelson | |
| 6,024,626 | A | 2/2000 | Mendelsohn | |
| 6,090,431 | A | 7/2000 | Franklin et al. | |
| 6,116,979 | A | 9/2000 | Weber | |
| 6,116,981 | A | 9/2000 | Zheng | |
| 6,158,740 | A | 12/2000 | Hall | |
| 6,231,416 | B1 * | 5/2001 | Clever et al. | 446/108 |
| 6,241,249 | B1 | 6/2001 | Wang | |
| 6,256,914 | B1 | 7/2001 | Yeh | |
| 6,277,428 | B1 | 8/2001 | Franklin et al. | |
| 6,280,282 | B1 | 8/2001 | Puchalski | |
| 6,386,540 | B1 | 5/2002 | Stevkovski | |
| 6,431,936 | B1 | 8/2002 | Kiribuchi | |
| 6,491,563 | B1 | 12/2002 | Bailey | |
| 6,566,992 | B1 | 5/2003 | Vicentelli | |
| 6,626,727 | B2 | 9/2003 | Balanchi | |
| 6,749,480 | B1 | 6/2004 | Hunts | |
| 6,846,216 | B1 | 1/2005 | Balanchi | |
| 6,963,261 | B2 | 11/2005 | Vicentelli | |
| 6,969,294 | B2 * | 11/2005 | Vicentelli | 446/92 |
| 2002/0115373 | A1 | 8/2002 | Lazerman | |
| 2002/0135125 | A1 | 9/2002 | Wu | |
| 2002/0167127 | A1 | 11/2002 | Fang | |
| 2004/0018473 | A1 | 1/2004 | Tusacciu | |
| 2004/0063380 | A1 | 4/2004 | Chi et al. | |

FOREIGN PATENT DOCUMENTS

| | | |
|---|---|---|
| FR | 2 153 792 | 9/1971 |
| FR | 2 301 279 | 2/1975 |
| GB | 2 123 306 A | 2/1984 |
| JP | 2001-173889 | 6/2001 |
| WO | WO 89/10604 | 11/1989 |
| WO | WO 99/60583 | 11/1999 |
| WO | WO 02/055168 | 7/2002 |
| WO | WO 02/076565 A1 | 10/2002 |

OTHER PUBLICATIONS

German Office Action Jun. 22, 2002.

Magna-Tiles Instruction Booklet, date unknown.

Gorbert, Matthew G., Orth, Maggie, and Ishii, Hiroshi, *Triangles: Tangible Interface for Manipulation and Exploration of Digital Information Topography*, Proceedings CH1/98, Apr. 18-23, 1998, pp. 49-56, CHI 98.

PCT International Search Report and Written Opinion Jan. 14, 2006.

* cited by examiner

MAGNETIC CONSTRUCTION KIT WITH WHEEL-LIKE COMPONENTS

CROSS-REFERENCE TO RELATED PRIORITY APPLICATION

This patent application claims priority of U.S. Provisional Application Ser. No. 60/536,866, filed Jan. 16, 2004, and entitled "Magnetic Construction Modules For Creating Three-Dimensional Assemblies", the disclosure of which is incorporated herein by reference in its entirety.

FIELD OF THE INVENTION

The present disclosure is directed generally to puzzles and toys. More particularly, the present disclosure is directed to a construction toy for building movable two and three-dimensional structures utilizing a primary connecting element in combination with various secondary connecting elements.

BACKGROUND OF THE INVENTION

Individuals often find enjoyment in the challenge of building aesthetic structural designs and/or functional structural models. Frequently, the utility associated with constructing such structures is found in the creative and/or problem solving process required to achieve a desired structural objective. Currently, construction assemblies that exploit magnetic properties to interlink various structural components and thereby form different two and/or three dimensional structures are known and can provide an added dimension of sophistication to the construction process. For example, the magnetic construction toy disclosed by Balanchi in U.S. Pat. No. 6,626,727, the modular assemblies disclosed by Vicentielli in U.S. Pat. No. 6,566,992, and the magnetic puzzle/toy disclosed by Smith in U.S. Pat. No. 5,411,262. A significant shortcoming associated with conventional magnetic construction assemblies, such as those disclosed in the aforementioned patents, involves inherently restrictive and at times penalizing design alternatives provided thereby. It is often the case that these traditional magnetic construction assemblies have only a limited number of component parts, which parts typically have constrained geometries to ensure effective and suitably stable or secure connections. Thus, despite efforts to date, a need remains for a magnetic construction kit that provides greater construction flexibility and/or design choice. Furthermore, it would be advantageous to provide a magnetic construction kit that is suitable for movement thereby providing an additional degree of design/construction sophistication.

These and other needs/objectives are addressed by the present invention. Additional advantageous features and functionalities of the present invention will be apparent from the disclosure which follows, particularly when reviewed in conjunction with the accompanying drawings.

SUMMARY OF THE INVENTION

According to an illustrative embodiment of the present invention, a movable magnetic construction kit is provided that permits improved structural profiles and increased construction flexibility and/or design choice. The present invention includes at least one primary or first connecting element having at least one aperture therein and a number of magnets operatively associated with a periphery or edge thereof, at least one second connecting element having an elongated body operatively associated with at least one magnet, and a third connecting element suitable to operatively connect with the first and/or second connecting elements. The first connecting element, in a preferred embodiment of the present invention is a hub-like structure suitable for rotating about a predefined axis of rotation.

BRIEF DESCRIPTION OF THE DRAWINGS

For a better understanding of the present invention, reference is made to the following detailed description of various exemplary embodiments considered in conjunction with the accompanying drawings, in which.

DISCLOSURE OF THE INVENTION

Figure 1:
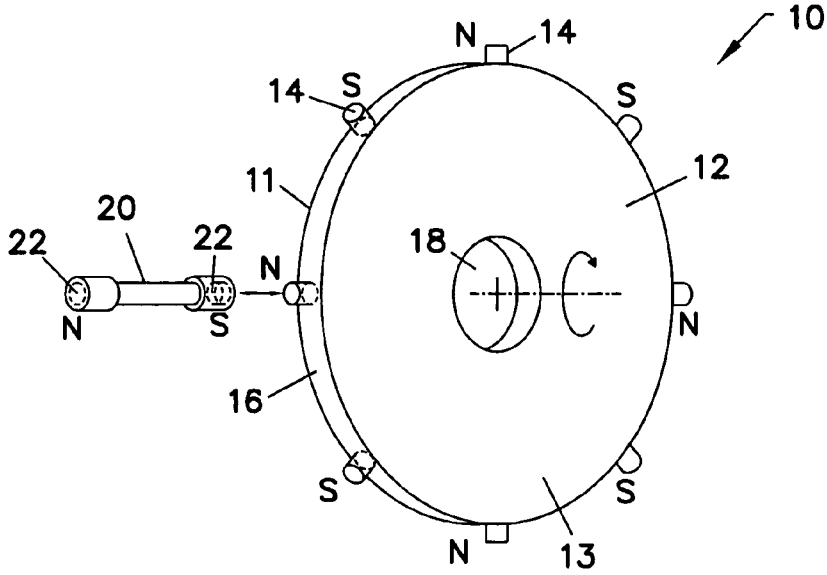
FIG. 1 is a perspective view of a primary connecting element operatively associated with a secondary connecting element in accordance with an illustrative embodiment of the present invention.

Referring to the drawings and, in particular, FIG. 1, a primary connecting element in accordance with an illustrative embodiment of the present invention is shown and generally represented by reference numeral 10. The primary connecting element 10, as shown, has an overall hub-like appearance with a disk-shaped, substantially planar body 12 having two faces, 11, 13, a number of primary magnets 14 operatively associated with a periphery or edge 16 thereof and at least one aperture 18 therein. In other embodiments of the present invention, the body 12 may have different shapes (e.g., polygonal, rectangular, etc.). As shown, the primary connecting element 10 is preferably operatively connectable with one or more secondary connecting elements 20. The secondary connecting elements 20 each have at least one secondary magnet 22 suitable for magnetically interacting with one or more of the primary magnets 14 associated with the primary connecting element 10. The primary magnets 14 of the primary connecting element 10 are preferably equally distributed with respect to each other. The polarities (i.e., north (N) or south (S)) of the primary magnets 14 are preferably staggered or oriented so that adjacent primary magnets 14 have different polarities, thereby providing optimal points of magnetic connection. However, in other embodiments of the present invention, the primary magnets 14 and/or the polarities thereof need not be so arranged and may be distributed and/or oriented in a variety of different ways.

Figure 2:
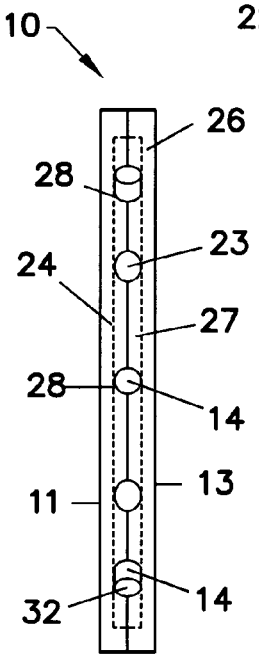
FIG. 2 is a first plan view of the primary connecting element of FIG. 1 in accordance with an exemplary embodiment of the present invention.

Referring to FIG. 2, the body 12 of the primary connecting element 10, in a preferred embodiment of the present invention, is a composite structure of a first half 24 and a second half 26 operatively connected via any known method for accomplishing such a task (e.g., adhesive, sonic welding, and/or other mechanical process). In this embodiment of the present invention, the first half 24 and the second half 26 are at least somewhat identical, and preferably substantially identical. The two halves 24, 26, together, may define a central compartment or cavity 27 suitable for accommodating an object such as a label or decoration (not shown). The first and second halfs 24, 26 preferably cooperate to fixedly hold or retain the respective primary magnets 14 and prevent any unwanted and/or inadvertent disengagement thereof. For example, in one embodiment of the present invention, the first and second halfs 24, 26 cooperate to form a number of magnet retaining pockets 28 about the edge 16 of the body 12. In other embodiments of the present invention wherein the body 12 is a solitary structure, the magnet retaining pockets 28 may, for example, be integrally formed in such solitary structure via a drilling or molding process.

The magnet retaining pockets 28 can have any of a variety of shapes, sizes and/or configurations. For instance, the magnet retaining pockets 28 can be cylindrical, square, rectangular, ovular, and polygonal or any other appropriate geometric shape. Preferably however, the magnet retaining pockets 28 are such that the corresponding primary magnet 14 accommodated thereby can be fixedly retained therein via any appropriate process or technique for accomplishing such an operation. For example, the magnet retaining pockets 28 and primary magnets 14 may be appropriately sized to cooperatively create a frictional bond of sufficient strength to prevent the inadvertent removal of the primary magnets 14. A suitable adhesive may also be utilized as appropriate to ensure a secure connection between the magnet retaining pockets 28 and the primary magnets 14. Still further, the respective magnet retaining pockets 28 can each have a retaining rim (not shown) for allowing effective receipt of the primary magnets 14 and preventing or at least substantially inhibiting the inadvertent removal thereof.

Figure 3:
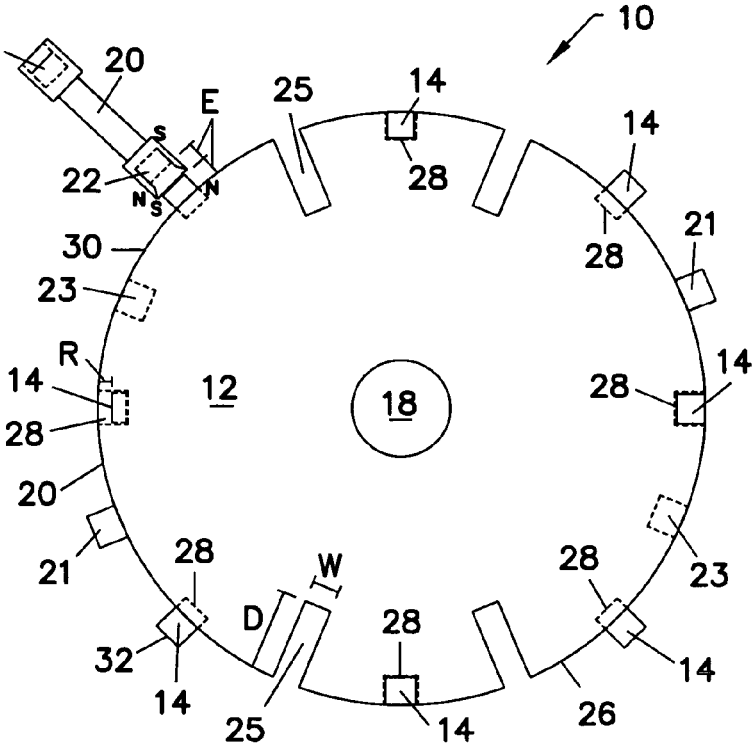
FIG. 3 is a second plan view of the primary connecting element of FIG. 2.

Referring to FIG. 3, in other embodiments of the present invention, different connecting arrangements may be utilized as appropriate to accomplish any of a variety of desired effects. For example, the magnet retaining pockets 28 can be configured to facilitate one or more primary magnets 14 being elevated a predefined extent ("E") with respect to an outer surface 30 of the edge 16. The respective primary magnets 14 can be elevated so that at least a portion of a top surface 32 thereof can make effective contact with, for example, the secondary magnet 22 operatively associated with the secondary connecting element 20. In addition, the respective primary magnets 14 can be accommodated by the magnet retaining pockets 28 so that the top surface 32 of such primary magnets 14 is substantially flush with respect to the outer surface 30 of the edge 16. Still further, the magnet retaining pockets 28 can facilitate one or more primary magnets 14 being recessed a predefined distance ("R") with respect to the outer surface 30 of the edge 16.

Still referring to FIG. 3, in an alternative embodiment of the present invention, the primary connecting element 10 can have one or more mechanical connectors, such as, for example, a protrusion 21, a recess 23, or a slot 25. Preferably, each mechanical connector is operatively connectable with a corresponding complementary connecting element. For example, the protrusion 21 may be well suited to cooperate with a secondary connecting element 20 having a complementary recess (not shown). Likewise, the recess 23 may be well suited for operatively connecting with a secondary connecting element 20 having a complementary protrusion (not shown). Further, the slot 25 having a predefined width W and depth D may be operatively associated with a secondary connecting element 20 having a complementary portion with the same or slightly less corresponding dimensions so as to be slidably received by the slot 25 as desired.

As may be recognized by those of ordinary skill in the pertinent art based on the teachings herein, the identified mechanical connectors are only exemplary, however, and numerous other connectors that are currently or later become known for providing a stable connection between any of a variety of secondary connecting elements 20 and the primary connecting element 10 equally may be used. For instance, each mechanical connector can be provided with a unique surface structure or texture (not shown) to improve further the mechanical connection between the respective connecting elements.

Figure 4:
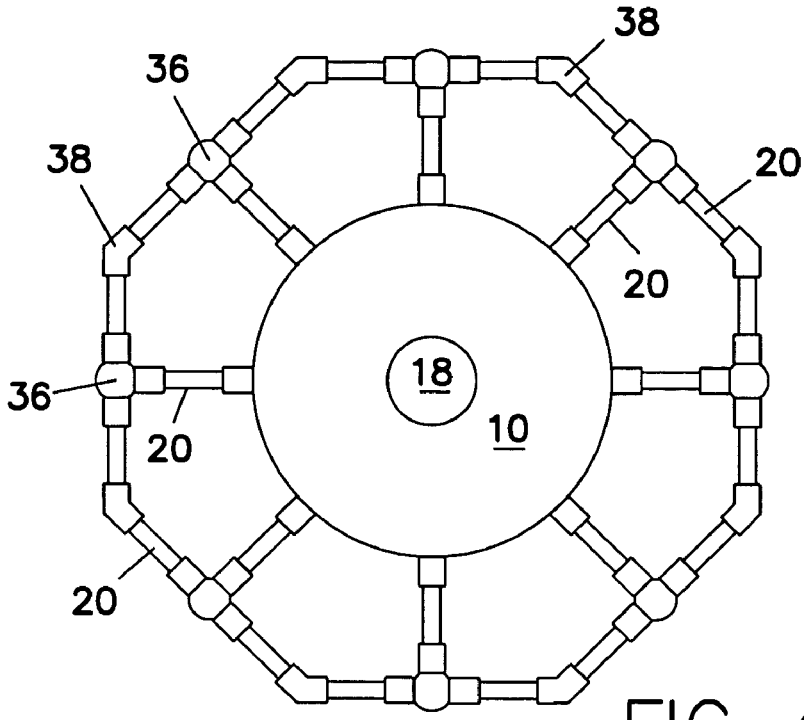
FIG. 4 is a schematic plan view of a movable magnetic construction kit connecting element in accordance with an exemplary embodiment of the present invention.

Referring to FIG. 4, in another embodiment of the present invention, the primary connecting element 10 can operatively cooperate with one or more of the secondary connecting elements 20, one or more third connecting elements 36, and/or one or more fourth connecting elements 38 to form any of a variety of different construction profiles. For example, as shown, the primary connecting element 10 may be operatively associated with a number of circumferentially spaced, radially extending elongated secondary connecting elements 20. The elongated secondary connecting elements 20, which preferably have secondary magnets 22 recessed a predefined extent E in each end thereof as demonstrated in FIG. 3, in turn, may each be operatively associated with a third connecting element. The third connecting element 36 may preferably operate as a flexible joint connecting two or more secondary connecting elements 20 distanced from the primary connecting element 10 so that the two or more secondary connecting elements 20 can be adjustably oriented in a variety of different directions relative to each other. For example, as shown, the third connecting element 36 can be a magnetically retainable, ferromagnetic or magnetizable ball or sphere of appropriate size to connect three secondary connecting elements 20 so that one element is radially oriented with respect to the primary connecting element 10 and the other two elements are at least substantially aligned with each other and, as shown, at least somewhat perpendicular with respect to the one element. Other arrangements would be readily apparent to one having ordinary skill in the pertinent art and equally may be used.

With reference to applicants' co-pending U.S. application filed concurrently herewith and entitled "Magnetic Construction Module With Interchangeable Magnet Holders", the disclosure of which is incorporated herein by reference in its entirety, it is noted that in an aspect of the present invention the spherical shape of the third connecting element 36 and the recessed secondary magnets 22 may allow for both a magnetic and a mechanical connection between each secondary connecting element 20 and the third connecting element 36. That is, a magnet may preferably be recessed with respect to the outer surface of a secondary connecting element a predefined depth (e.g., determined by the geometry of the third connecting element) so that a beveled edge is formed enabling the third connecting element to be both magnetically and mechanically connected to the secondary connecting element. This magnetic/mechanical connection arrangement may also be utilized with respect to the primary magnets 14 and pockets 28 of the primary connecting element 10. Accordingly, by utilizing both magnetic and mechanical connecting properties, this magnetic/mechanical connection arrangement, and other like configurations, may advantageously provide for greater connection stability or performance.

It is noted that it would be readily apparent to one of ordinary skill in the pertinent art based on the teachings herein that the third connecting element 36 can have any of a variety of other geometric shapes, sizes, or configurations suitable to effectively cooperate with at least the secondary connecting elements 20. For instance, the third connecting element 36, which, as previously noted, can preferably be made from a magnetizable material, can have a non-magnetic cover (not shown) providing restrictive access to the magnetizable third connecting element 36. The cover can be suitable to facilitate any of a variety of different mechanical and/or magnetic connections.

Furthermore, the secondary connecting elements 20 can each be operatively associated with one or more fourth connecting elements 38, which preferably operate as a rigid joint connecting two or more secondary connecting elements 20 at a distance from the primary connecting element 10 and so that the two or more secondary connecting elements 20 are rigidly oriented in predefined directions with respect to each other. For example, as shown, the fourth connecting element 38 can be a curved member forming an elbow and connecting two secondary connecting elements 20 so that they are oriented at a predefined angle relative to each other. The fourth connecting elements 38 may be magnetically connected to the primary connecting element 10, the secondary connecting elements 20, the third connecting elements 36, and/or additional fourth connecting elements 38.

Figure 5:
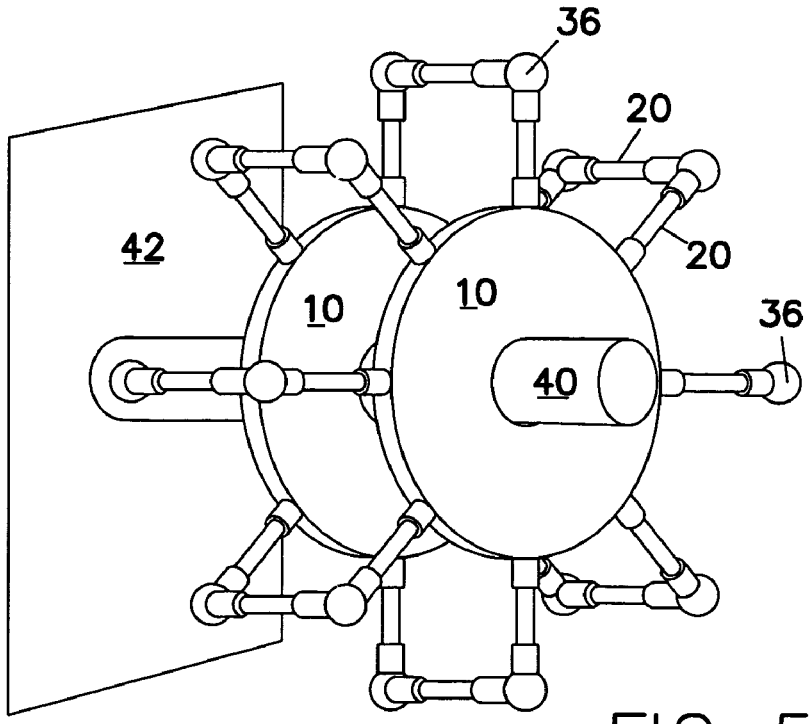
FIG. 5 is a perspective view of a movable magnetic construction kit in accordance with another exemplary embodiment of the present invention.

Referring to FIG. 5, in order to create dynamic movable magnetic construction profiles, one or more primary connecting elements 10 can be supported by an axle element 40. As shown, the axle element 40 preferably facilitates two or more primary connecting elements 10 to be operatively connected via the secondary connecting elements 20, the third connecting elements 36, and/or the fourth connecting elements to form any of a variety of construction profiles. The size and extent of such construction profiles is limited only by the relative magnetic strength associated with the magnets utilized with respect to the weight of the various connecting elements employed.

As shown, the axle element 40 preferably traverses the aperture 18 of each primary connecting element 10 supported thereby. The axle element 40 can have any of a variety shapes, sizes and/or configurations. Further, the axle element 40 may be permanently or detachably connected to a support surface 42. Still further, the axle element 40 can be operatively associated with an electromechanical device (not shown) for directly or indirectly providing an initial and/or continual work of movement force to any primary connecting element 10 supported the axle element 40. Alternatively, the axle element 40 can facilitate manually rotating any primary connecting element 10 supported thereby. In an embodiment of the present invention, once motion has been initiated, via manual or electrical means, such motion may be extended without continual manual and/or electrical aid for a specified time period by utilizing certain magnetic arrangements. For example, a first primary connecting element 10 and/or the secondary connecting elements 20 associated therewith may be positioned sufficiently close to a second primary connecting element 10 and/or the secondary connecting elements 20 associated therewith so that, in operation, once the first primary connecting element 10 is put into rotation.

Having identified and discussed various components and features of the present invention, it will be understood by one skilled in the art that such components and/or features may be operatively connected to form any of a variety of different construction profiles, such as those disclosed in applicants' copending U.S. patent application filed concurrently herewith and entitled "Magnetic Construction Modules For Creating Three-Dimensional Assemblies," the disclosure of which is incorporated herein by reference in its entirety. Although illustrative and exemplary embodiments of the present invention have been described with reference to the schematic illustrations herein, the present invention is not limited thereto. Rather, the various structural components and/or assemblies disclosed herein are susceptible to modification and/or variation without departing from the spirit or scope of the present invention.

What is claimed is:

1. A movable magnetic construction kit comprising:

at least one first connecting element having at least one aperture therein and a number of first magnets equally distributed about an edge thereof;

one or more second connecting elements having an elongated body and at least one second magnet operatively associated therewith; and at least one additional connecting element for connecting two or more of said second connecting elements, wherein said first connecting element is operatively associated with at least one support element so as to be rotatable thereabout.

2. The construction kit of claim 1, wherein said first connecting element has a body defining an annular disc.

3. The construction kit of claim 1, wherein said number of magnets of said first connecting element are arranged so that adjacent magnets have different polarity relative to each other.

4. The construction kit of claim 1, wherein said number of magnets are recessed with respect to said edge of said first connecting element.

5. The construction kit of claim 1, wherein said number of magnets project outwardly with respect to said edge of said first connecting element.

6. The construction kit of claim 5, wherein said second connecting elements include at least one magnet retaining element having a pocket for securely retaining said at least one second magnet in a recessed manner.

7. The construction kit of claim 6, wherein said magnet retaining elements are separable with respect to said elongated body.

8. The construction kit of claim 1, wherein said second magnet of said one or more second connecting elements is magnetically connected to one of said first magnets of said first connecting element.

9. The construction kit of claim 8, wherein said additional connecting elements are spherical and magnetizable.

10. The construction kit of claim 9, wherein said additional connecting elements flexibly connect two or more second connecting elements so that such second connecting elements can be adjustably oriented in a variety of different directions with respect to each other.

11. The construction kit of claim 10, wherein said first connecting element cooperates with said second connecting elements and said additional connecting elements to form a first structural profile.

12. The construction kit of claim 11, wherein said first structural profile cooperates with said support element via said aperture of said first connecting element so as to be movable thereabout.

13. The construction kit of claim 12, wherein said first structural profile cooperates with a second structural profile via at least one of said second connecting elements, said additional connecting elements, and said support element.

14. The construction kit of claim 13, wherein said first structural profile and said second structural profile are simultaneously movable via said support member.

15. The construction kit of claim 13, wherein said first structural profile and said second structural profile are separably movable via said support member.

16. A connecting element for use in a movable magnetic construction kit, said connecting element comprising:

a substantially flat body having at least one aperture therethrough and a number of magnets operatively associated with an edge thereof, said magnets being equally distributed with respect to each other and oriented so that adjacent magnets have different exposed polarities, wherein said flat body is operatively associated with at least one support element so as to be rotatable thereabout, and wherein said number of magnets are recessed with respect to said edge of said flat body.

17. The connecting element of claim 16, further comprising one or more mechanical connectors located about said edge of said flat body.

18. The connecting element of claim 16, wherein said flat body defines an annular disc.

19. A connecting element for use in a movable magnetic construction kit, said connecting element comprising:

a substantially flat body having at least one aperture therethrough and a number of magnets operatively associated with an edge thereof, said magnets being equally distributed with respect to each other and oriented so that adjacent magnets have different exposed polarities, wherein said flat body is operatively associated with at least one support element so as to be rotatable thereabout, and wherein said number of magnets project outwardly with respect to said edge of said flat body.

20. The connecting element of claim 19, further comprising one or more mechanical connectors located about said edge of said flat body.

* * * * *